US008767999B2

(12) United States Patent
Shin

(10) Patent No.: US 8,767,999 B2
(45) Date of Patent: Jul. 1, 2014

(54) SLIMLINE SPEAKER

(76) Inventor: Joung Youl Shin, Gyeonggi-do (KR)

( * ) Notice: Subject to any disclaimer, the term of this patent is extended or adjusted under 35 U.S.C. 154(b) by 0 days.

(21) Appl. No.: 13/392,722

(22) PCT Filed: Aug. 23, 2010

(86) PCT No.: PCT/KR2010/005577

§ 371 (c)(1),
(2), (4) Date: Apr. 19, 2012

(87) PCT Pub. No.: WO2011/025193

PCT Pub. Date: Mar. 3, 2011

(65) Prior Publication Data

US 2012/0195457 A1 Aug. 2, 2012

(30) Foreign Application Priority Data

Aug. 27, 2009 (KR) ..... 10-2009-0079669

(51) Int. Cl.
*H04R 1/00* (2006.01)

(52) U.S. Cl.
USPC ..... 381/398; 381/404; 381/420; 381/423; 381/396; 381/412; 381/416; 181/171; 181/172

(58) Field of Classification Search
None
See application file for complete search history.

(56) References Cited

U.S. PATENT DOCUMENTS 5,847,333 A * 12/1998 D'Hoogh ..... 181/171
6,963,651 B2 * 11/2005 Peng ..... 381/401
7,184,567 B2 * 2/2007 Sugata et al. ..... 381/433
7,236,607 B2 * 6/2007 D'Hoogh ..... 381/396
2002/0034315 A1 * 3/2002 Auerbach et al. ..... 381/403
2004/0076309 A1 * 4/2004 Sahyoun ..... 381/412
2009/0290748 A1 * 11/2009 Kam ..... 381/398
2010/0046788 A1 * 2/2010 Harris et al. ..... 381/404

FOREIGN PATENT DOCUMENTS

JP 2001-313996 A 11/2001
JP 2006129106 A 5/2006
KR 100279702 B 2/2001
KR 100638057 B 10/2006
KR 1020080001615 A 1/2008

OTHER PUBLICATIONS

International Search Report for PCT/KR2010/005577 mailed from ISA/KR on Apr. 15, 2011.
Written Opinion of the International Searching Authority for PCT/KR2010/005577 mailed from ISA/KR on Apr. 15, 2011.

* cited by examiner

*Primary Examiner* — Duc Nguyen
*Assistant Examiner* — Taunya McCarty
(74) *Attorney, Agent, or Firm* — Sughrue Mion, PLLC

(57) ABSTRACT

A slimline speaker comprises: a magnetic circuit having a magnet and yoke disposed to form a separating space in the horizontal direction; a bobbin on which a voice coil is mounted and of which the lower side is inserted in the separating space between the magnet and yoke; a base frame for mounting the magnetic circuit; a damper having an inside edge coupled to the bobbin and an outside edge coupled to the base frame; and a diaphragm having an inside edge coupled to a point lower down than the point where the damper is coupled on the bobbin, and an outside edge coupled to the base frame.

22 Claims, 16 Drawing Sheets

SLIMLINE SPEAKER

RELATED APPLICATIONS

The present application is a National Phase of International Application Number PCT/KR2010/005577, filed Aug. 23, 2010, and claims priority from, Korean Application Number 10-2009-0079669, filed Aug. 27, 2009.

TECHNICAL FIELD

The present invention relates to a speaker, and more specifically, to a slimline speaker capable of decreasing the entire height of the speaker even while forming a diaphragm in a cone shape.

BACKGROUND ART

A speaker is a device that converts an electrical signal into a sound signal. The speaker has a structure in which a bobbin having a voice coil wound therearound is inserted into a magnetic circuit having a magnet, a plate and a yoke, so that the bobbin and a diaphragm connected to the bobbin are vibrated by the magnetic force generated in the magnetic circuit, thereby outputting sounds.

Hereinafter, a conventional speaker will be described in detail with reference to the drawing.

FIG. 1 is a sectional view of a conventional speaker.

As shown in FIG. 1, the conventional speaker is provided with a base frame 10 formed to a thickness of about 1.0 to 1.2 mm using iron (Fe) or synthetic resin. A magnetic circuit part 20 generating a magnetic force is coupled to the base frame 10 at the bottom side of the base frame 10, and a vibration part 30 generating an electric force is mounted in the inside of the base frame 10.

The magnetic circuit part 20 comprises a ring-shaped plate 21, a ring-shaped magnet 23 and a yoke 25. Here, the plate 21 is coupled to the bottom of the base frame 10, and the magnet 23 is coupled to the bottom of the plate 21. The yoke 25 has a support plate 25*a* coupled to the bottom of the magnet 23 and a pole 25*b* passing upward through the inside of the magnet 23 and the plate 21.

The vibration part 30 comprises a diaphragm 31, a bobbin 33 and a damper 35. Here, the diaphragm 31 has an edge side coupled to the top side of the base frame 10. The bobbin 33 is formed in the shape of a cylinder having a voice coil wound around an outer circumferential surface thereof so that the upper side of the bobbin 33 is coupled to the diaphragm 31 and the lower side of the bobbin 33 is inserted between the plate 21 and the pole 25*b*. The damper 35 has an outer circumferential surface coupled to the base frame 10 and an inner circumferential surface coupled to the bobbin 33. In this case, the damper 35 functions to guide the bobbin 33 to be vibrated in a certain direction so that the bobbin 33 is not vibrated in the horizontal direction but vibrated in the vertical direction.

If external power is supplied to the voice coil, the bobbin is vertically vibrated by an action between the magnetic circuit 20 and the voice coil wound around the bobbin 33, and therefore, sounds are generated by vibrating the diaphragm 31.

However, in the conventional speak configured as described above, the inner circumferential surface of the damper 35 should be coupled to the bobbin 33 at a point lower than the diaphragm 31 so that the diaphragm 31 and the damper 35 are not interfered with each other when the bobbin 33 is vertically vibrated. The diaphragm 31 is extended to slope in such a way that the height of the outside edge is greater than that of the inside edge. Hence, there is a structural limitation in implementing the slimness of products, i.e., in decreasing the entire height of the product.

Accordingly, there has been proposed a planar speaker in which a diaphragm is extended in the horizontal direction for the purpose of manufacturing slimline products. However, if the diaphragm is formed in the shape of a horizontal flat plate, deformation such as warp may easily occur when the diaphragm is vibrated. In order to solve such a problem, a planar diaphragm may be bent to increase the strength of the diaphragm or may be formed using a diaphragm material of which the thickness is thick. In this case, the entire thickness of the diaphragm is increased by the thickness of the bent diaphragm or diaphragm material. Therefore, it is difficult to manufacture a speaker suitable for middle/low tone, high power and high sound quality while being thin in thickness.

DETAILED DESCRIPTION

Technical Problems

It is thus an object of the present invention to provide a slimline speaker which can allow products to be slim by decreasing the entire height of the product and decrease the entire height of the product even while applying a diaphragm formed in a shape for preventing deformation by increasing the strength of the diaphragm, i.e., a diaphragm formed to slope or bend so as to be suitable for middle/low tone and high power.

Technical Solutions

To solve the objective, the present invention provides a slimline speaker comprising: a magnetic circuit having a magnet and yoke disposed so as to have a separating space in the horizontal direction; a bobbin on which a voice coil is mounted and of which the lower side is inserted in the separating space between the magnet and yoke; a base frame for mounting the magnetic circuit; a damper of which the inside edge is coupled to the bobbin, and the outside edge is coupled to the base frame; and a diaphragm of which the inside edge is coupled to a point lower down than the point where the damper is coupled on the bobbin, and the outside edge is coupled to the base frame.

The present invention also provides a slimline speaker comprising: a magnetic circuit having a magnet and yoke disposed so as to have a separating space in the horizontal direction; a bobbin on which a voice coil is mounted and of which the lower side is inserted in the separating space between the magnet and yoke; a base frame for mounting the magnetic circuit; a diaphragm coupled to the bobbin so as to cover the top of the bobbin, and of which the outer edge is coupled to the base frame; and a damper of which the bottom is coupled to the top surface of the diaphragm, and of which the outside edge is coupled to the base frame.

The present invention also provides a slimline speaker comprising: a base frame; a bridge of which the bottom is spaced apart from the top of the base frame, and of which the outside edge is coupled to the outside edge of the base frame; a magnetic circuit having a magnet and yoke disposed so as to have a separating space in the horizontal direction, and coupled to the bottom surface of the bridge; a bobbin on which a voice coil is mounted and of which the upper side is inserted in the separating space between the magnet and yoke; a damper of which the inside edge is coupled to the bobbin, and the outside edge is coupled to the base frame or the bridge; and a diaphragm of which the inside edge is coupled to a point higher than that at which the damper is coupled on the bobbin, and of which the outside edge is coupled to the base frame or the bridge.

The present invention also provides a slimline speaker comprising: a base frame; a bridge of which the bottom is spaced apart from the top of the base frame, and of which the outside edge is coupled to the outside edge of the base frame; a magnetic circuit having a magnet and yoke disposed so as to have a separating space in the horizontal direction, and coupled to the bottom surface of the bridge; a bobbin on which a voice coil is mounted and of which the upper side is inserted in the separating space between the magnet and yoke; a diaphragm coupled to cover the bottom of the bobbin, and of which outside edge is coupled to the base frame or the bridge; and a damper of which the top surface is coupled to the bottom surface of the diaphragm, and of which the outside edge is coupled to the base frame or the bridge.

Advantageous Effects

Based on the above structure, the slimline speaker according to the present invention enables products to be slim while applying a diaphragm formed to slope or bend so that the deformation of the diaphragm is prevented by improving the strength of the diaphragm. Further, a damper can be stably coupled to a bobbin. Since the damper can be used as a terminal, it is possible to simplify the internal structure of the slimline speaker.

BEST MODES FOR PRACTICING INVENTION

Hereinafter, embodiments of a slimline speaker according to the present invention will be described in detail with reference to the accompanying drawings.

Figure 1:
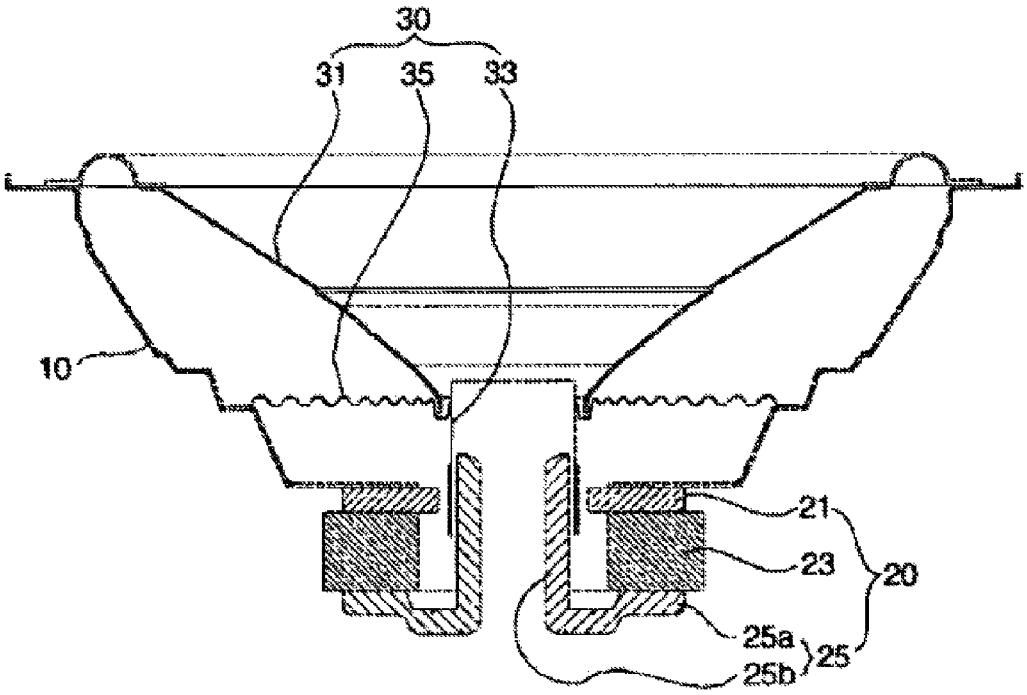
FIG. 1 is a sectional view of a conventional speaker.
Figure 2:
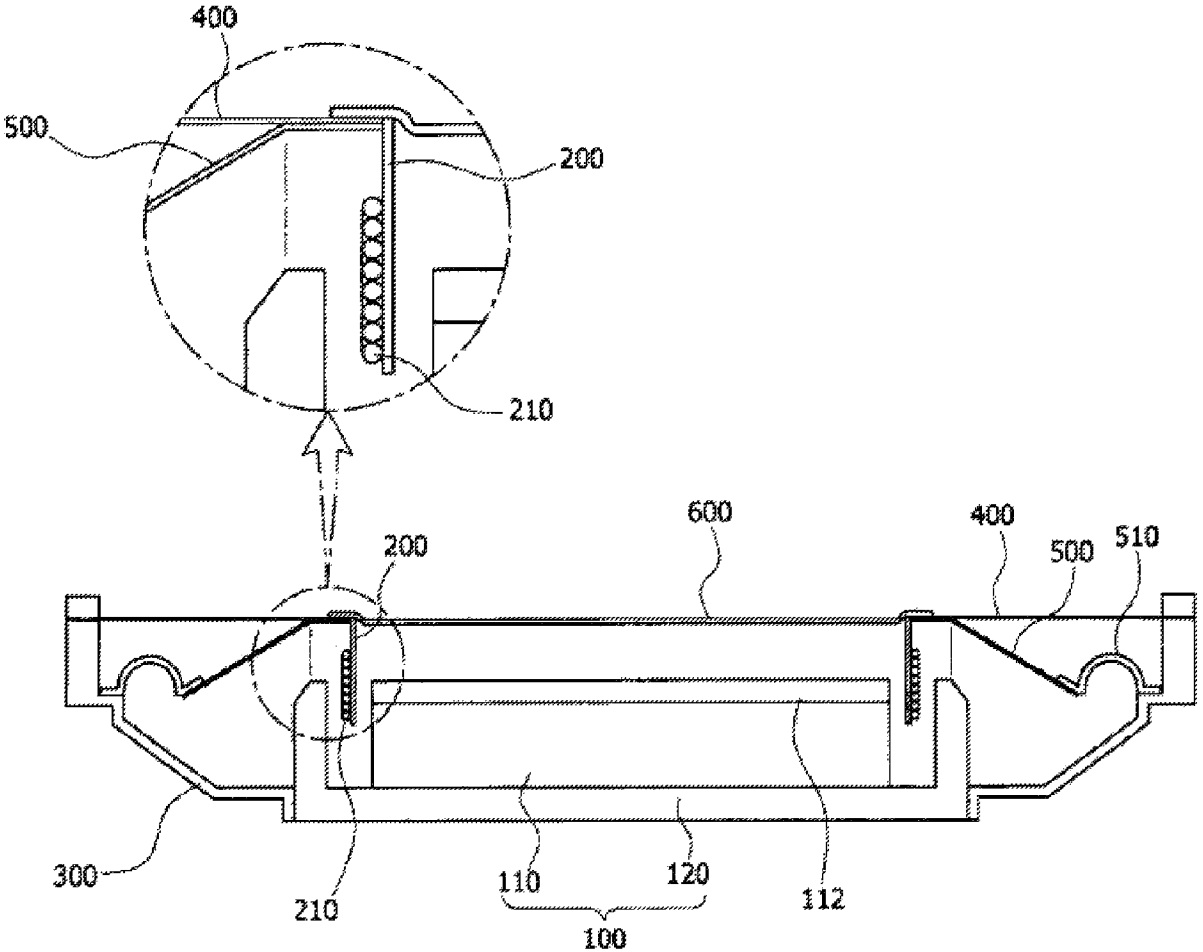
FIG. 2 is a sectional view of a slimline speaker according to a first embodiment of the present invention.

FIG. 2 is a sectional view of a slimline speaker according to a first embodiment of the present invention.

As shown in FIG. 2, the slimline speaker according to first embodiment of the present invention comprises a magnetic circuit 100 having a magnet 110 and a yoke 120, a bobbin 200 formed in a cylindrical shape, a base frame 300, a damper 400 and diaphragm 500. Here, the magnet 110 and yoke 120 are disposed to have a separating space in the horizontal direction, of which the top is opened. The bobbin 200 has a voice coil 210 wound around an outer circumferential surface thereof, and a lower side of the bobbin 200 is inserted into the separating space between the magnet 110 and the yoke 120. The base frame 300 is coupled to the yoke 120, and the outside edge of the base frame 300 is extended up to a position higher than the magnetic circuit 100. The damper 400 and the diaphragm 500 are coupled to the bobbin 200 at the top of the bobbin 200. In this case, a plate 112 for gathering the magnetic force of the magnet 110 is mounted on the top surface of the magnet 110, and an edge 510 is provided at the outer end of the diaphragm 500 so that the vibration in the vertical direction can be smoothly made.

Thus, if current is applied to the voice coil 210, the bobbin 200 is vertically vibrated by the relation of the current with a magnetic field generated between the magnet 110 and the yoke 120, and the diaphragm 500 coupled to the bobbin 200 is vertically vibrated, thereby outputting sounds. As the current is applied to the voice coil 210 as described above, the operational principle of the components of the slimline speaker outputting sounds is substantially identical to that of the conventional speaker, and therefore, its detailed description will be omitted.

The slimline speaker according to this embodiment is different from the conventional speaker in that the damper 400 is not mounted at a position lower than the diaphragm 500 but mounted at a position higher than the diaphragm 500. That is, the damper 400 is formed to have a through-hole at the central part thereof so that the inside edge (more precisely, the inner circumferential surface of the through-hole) of the damper 400 is coupled to the outer circumferential surface of the bobbin 200, and the outside edge (edge part) of the damper 400 is connected to the base frame 300. The diaphragm 500 also has a through-hole at the central part thereof so that the inside edge of the diaphragm 500 is coupled to a point lower than that at which the damper 400 is coupled on the outer circumferential surface of the bobbin 200 and the outer edge of the damper 400 is connected to the base frame 300.

If the diaphragm 500 is mounted at a side (a lower side in FIG. 2) closer to the magnetic circuit 100 than the damper 400 as described above, the space between the magnetic circuit 100 and the damper 400 can be used. Thus, the height of the diaphragm 500 does not have influence on the thickness of products, and accordingly, the entire height of the product can be remarkably decreased.

The diaphragm 500 may be disposed horizontally as that applied to a planar speaker is, or may be formed to have a slope as shown in this embodiment. If the diaphragm 500 is formed to slope in such a way that the height of the outside edge is greater than that of the inside edge, the damper 400 may be interfered by the diaphragm 500. Therefore, it is necessary that the diaphragm 500 should be formed to slope in such a way that the height of the inside edge is greater than that of the outside edge. It will be apparent that the vertical distance between the damper and the diaphragm 500 is sufficiently secured, the diaphragm 500 may be formed to slope in such a way that the height of the outside edge is greater than that of the inside edge. However, the entire height of the product is increased in order to sufficiently secure the vertical distance between the damper 400 and the diaphragm 500, and therefore, the diaphragm 500 is preferably formed to slope in such a way that the height of the inside edge is greater than that of the outside edge.

The diaphragm 500 formed to slope in such a way that the height of the inside edge is greater than that of the outside edge as shown in this embodiment suffers from less deformation such as warp in vibration than that formed in the shape of a horizontal plate. Thus, the slimline speaker according to this embodiment can be implemented as a slimline product such as a planar speaker, and can be used as a speaker suitable for middle/low tone and high power like a cone-shaped speaker.

In order to decrease the entire height of the slimline speaker according to this embodiment as many as possible, the inside edges of the damper 400 and the diaphragm 500 are coupled to have a structure in which the inside edges of the damper 400 and the diaphragm 500 are stacked with each other. If the diaphragm 500 is formed to slope in such a way that the height of the inside is greater than that of the outside, the diaphragm 500 may be interfered with the top surface of a sidewall of the yoke 120 in the vibration thereof. Therefore, the diaphragm 500 is preferably configured so that, as shown in FIG. 2, a part from the inside edge to the outermost point (the point designated by a virtual line) on the top surface of the sidewall of the yoke 120 is coupled to the damper 400 in a stacking fashion, and the other part is formed to slope in such a way that the height of the inside edge is greater than that of the outside edge while being spaced apart from the damper 400.

Since the damper 400 is generally formed of a material having higher restoration elasticity and strength than that of the diaphragm 500, the damper 400 suffers from less deformation and damage than the diaphragm 500. If the diaphragm 500 is positioned more inside the base frame 300 than the damper 400 in the slimline speaker according to this embodiment, the damper 400 functions to protect the diaphragm 500 from an external impact. Thus, it is possible to reduce the deformation and damage of the diaphragm 500.

Only the structure in which the damper 400 and the inside edge of the diaphragm 500 contact each other is illustrated in this embodiment. However, in order to prevent the interference between the diaphragm 500 and the damper 400 in the vibration of the diaphragm 500, the diaphragm 500 may be formed at a lower side from the damper 400 so that the top of the diaphragm 500 is spaced apart from the bottom of the damper 400.

The slimline speaker according to this embodiment may further comprise a dust cap 600. The dust cap 600 covers the top of an internal space of the bobbin 200 so as to prevent dust and foreign matter from coming into the internal space of the bobbin 200.

When the diaphragm 500 is vibrated, sounds are outputted not only to the upside of the diaphragm 500 but also to the downside of the diaphragm 500. If upper and lower spaces of the diaphragm 500 are not completely isolated from each other, the sound outputted to the downside of the diaphragm 500 is transferred to the upside of the diaphragm 500 and then offset by the sound outputted to the upside of the diaphragm 500 while colliding with the sound outputted to the upside of the diaphragm 500. Therefore, the sound may not be normally outputted, like the degradation of the sound, etc. However, if the dust cap 600 is additionally provided as described above, the upper and lower spaces of the diaphragm 500 are isolated from each other. Thus, the sound outputted to the downside of the diaphragm 500 does not collide with the sound outputted to the upside of the diaphragm 500, and accordingly, an abnormal sound output such as the degradation of sound is reduced.

The base frame 300 to which the magnetic circuit 100, the damper 400 and the dust cap 600 are coupled may be configured so that the base frame 300 is formed in the shape of a concave container having a bottom surface and a sidewall, and the magnetic circuit 100 is mounted on the bottom surface of the base frame 300. However, if the magnetic circuit 100 is coupled in a stacked structure on the bottom surface of the base frame 100, the entire thickness of the product is increased by the thickness of the bottom of the base frame 300.

Therefore, in order to further decrease the entire thickness of the slimline speaker according to this embodiment, as shown in FIG. 2, the magnetic circuit 100 may be coupled to the base frame 300 so that a through-hole is formed in the bottom surface of the base frame, and the magnetic circuit 100 is inserted into the through-hole.

Although only the structure in which the yoke 120 is formed in a concave shape so that the sidewall of the yoke 120 corresponds to the outer circumferential surface of the bobbin 200 and the magnet 110 is formed in a cylindrical shape so as to correspond to the inner circumferential surface of the bobbin 200 is illustrated in this embodiment, the magnet 110 may be formed in a ring shape so as to correspond to the outer circumferential surface of the bobbin 200, and the yoke 120 may be formed in the shape of a pole of which central part is protruded upward so as to be positioned at the inside of the bobbin 200. However, there is a difficulty in manufacturing the slimline speaker so that the magnet 110 and the plate are formed in a ring shape and the yoke 120 is formed into a structure having a bottom plate and a pole. Therefore, as described in this embodiment, the magnet 120 and the yoke 120 are preferably formed in the shapes of a cylinder and a concave container, respectively.

Figure 3:
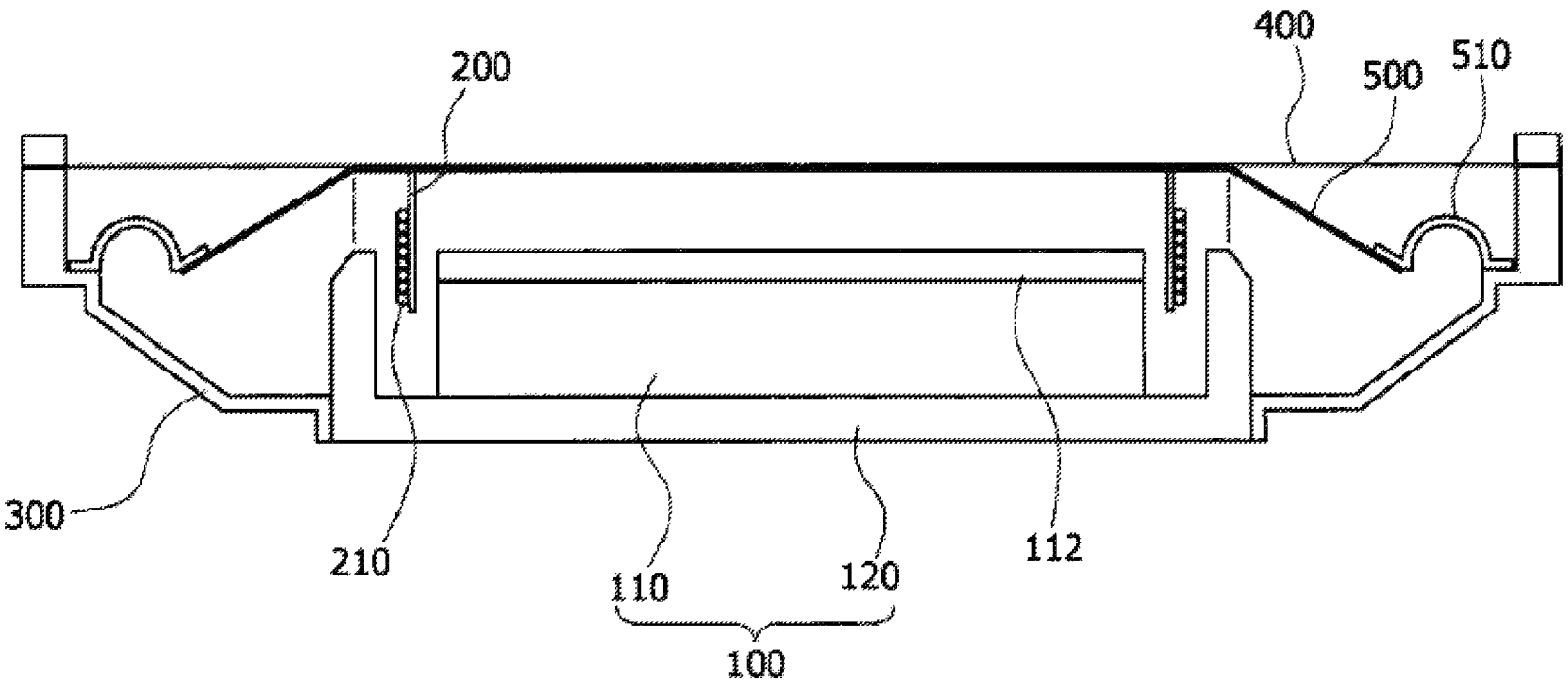
FIG. 3 is a sectional view of a slimline speaker according to a second embodiment of the present invention.

FIG. 3 is a sectional view of a slimline speaker according to a second embodiment of the present invention.

In the slimline speaker according to the second embodiment of the present invention, a diaphragm 500 may coupled to a bobbin 200 into a structure in which the diaphragm 500 covers the top of the bobbin 200 so as to prevent dust and foreign matter from coming into the inside of the bobbin 200 without a separate dust cap 600, and a damper 400 may be coupled to the diaphragm 500 into a structure in which the damper 400 is stacked on the top surface of the diaphragm 500.

If the diaphragm 500 and the damper 400 are coupled to the bobbin 200 into a structure in which the diaphragm 500 and the damper 400 are stacked on the top of the bobbin 200, the dust cap 600 can be omitted. Thus, it is possible to decrease the number of components, to facilitate the coupling between the diaphragm 500 and the damper 400 and to improve the coupling performance between the diaphragm 500 and the damper 400. Accordingly, the lifetime of the slimline speaker can be prolonged.

Figure 4:
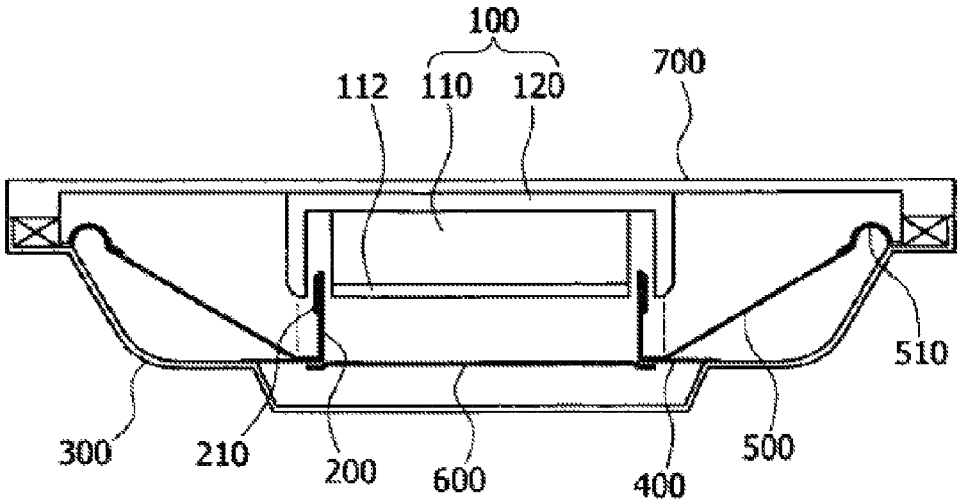
FIG. 4 is a sectional view of a slimline speaker according to a third embodiment of the present invention.
Figure 5:
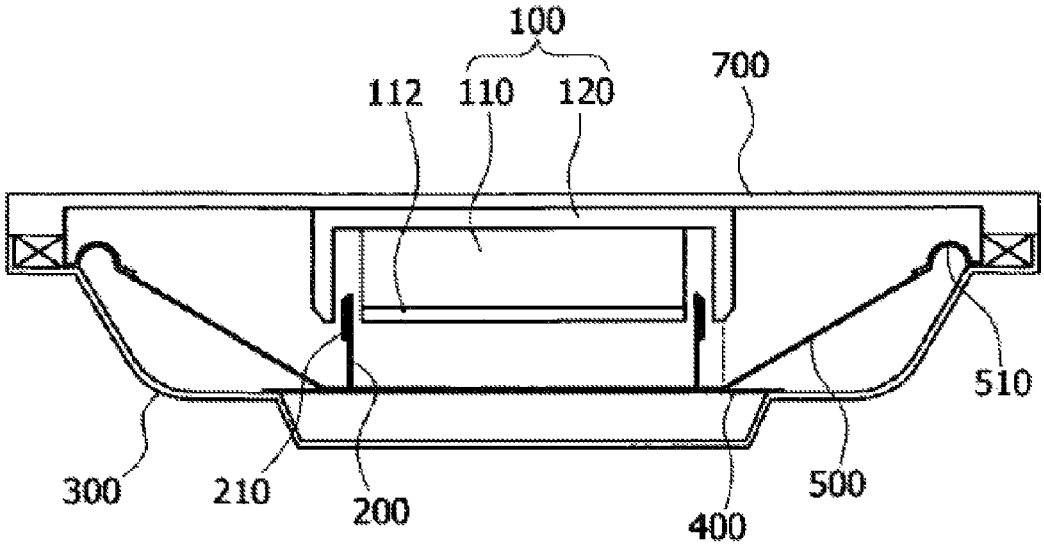
FIG. 5 is a sectional view of a slimline speaker according to a fourth embodiment of the present invention.

FIG. 4 is a sectional view of a slimline speaker according to a third embodiment of the present invention. FIG. 5 is a sectional view of a slimline speaker according to a fourth embodiment of the present invention.

The slimline speakers according to the third and fourth embodiments of the present invention may be configured so that the separating space between a magnet 110 and a yoke 120 is opened downward, and a bobbin 200 is positioned at the downside of a magnetic circuit 100.

That is, the slimline speaker comprises a base frame 300, a bridge 700, the magnetic circuit 100, the bobbin 200, a damper 400 and a diaphragm 500. Here, the bridge 700 is coupled to the outside edge of the base frame 300. The magnetic circuit 100 has the magnet 110 and yoke 120 disposed to have a separating space in the horizontal direction, and is coupled to a bottom of the bridge 700. The bobbin 200 has a voice coil 210 mounted thereto, and an upper side of the bobbin 200 is inserted into the separating space between the magnet 110 and the yoke 120. The damper 400 is coupled to the bottom of the bobbin 200, and the outside edge of the damper 400 is connected to the base frame 300. The diaphragm 500 is coupled to a point higher than that at which the damper 400 is coupled on the bobbin 200, and the outside edge of the diaphragm 500 is extended higher than the inside edge of the diaphragm 500 so as to be connected to the base frame 300.

If the positions of the magnetic circuit 100 and the bobbin 200 are vertically reversed, the diaphragm 500 is positioned between the magnetic circuit 100 and the damper 400 even if the diaphragm 500 is formed in the shape of a cone (the shape in which the outside edge is extended higher than the inside edge) like the conventional cone-shaped speaker. Thus, the entire thickness of the slimline speaker can be decreased. In this case, the bridge 700 is formed in the shape of a plate so that sounds outputted to the upside of the diaphragm 500 can be more smoothly propagated to the outside. Preferably, the bridge 700 has a plurality of through-holes formed therein, or is formed in the shape of the base frame 300.

As shown in the embodiments of FIGS. 4 and 5, the bridge 700 mounted to cover the top of the base frame 300 can be implemented to protect, from an external impact, various types of components including the magnetic circuit 100, the bobbin 200, the damper 400 and the diaphragm 500, mounted in the inside of the base frame 300. Thus, a separate protective net applied to the conventional speaker can be omitted.

Meanwhile, in order to prevent dust and foreign matter from coming into the inside of the bobbin 200 even when the bobbin 200 is positioned at the lower side of the magnetic circuit, a dust cap 600 covering the bottom of the internal space of the bobbin 200 may be additionally provided as shown in FIG. 4, or the diaphragm 500 and the damper 400 be coupled to the bobbin 200 so that the diaphragm 500 and the damper 400 sequentially cover the bottom of the bobbin 200. The effect obtained by covering the bottom of the bobbin 200 using the dust cap 600 or using the diaphragm 500 and the damper 400 is identical to that in the embodiment shown in FIGS. 2 and 3, and therefore, its detailed description will be omitted.

Figure 6:
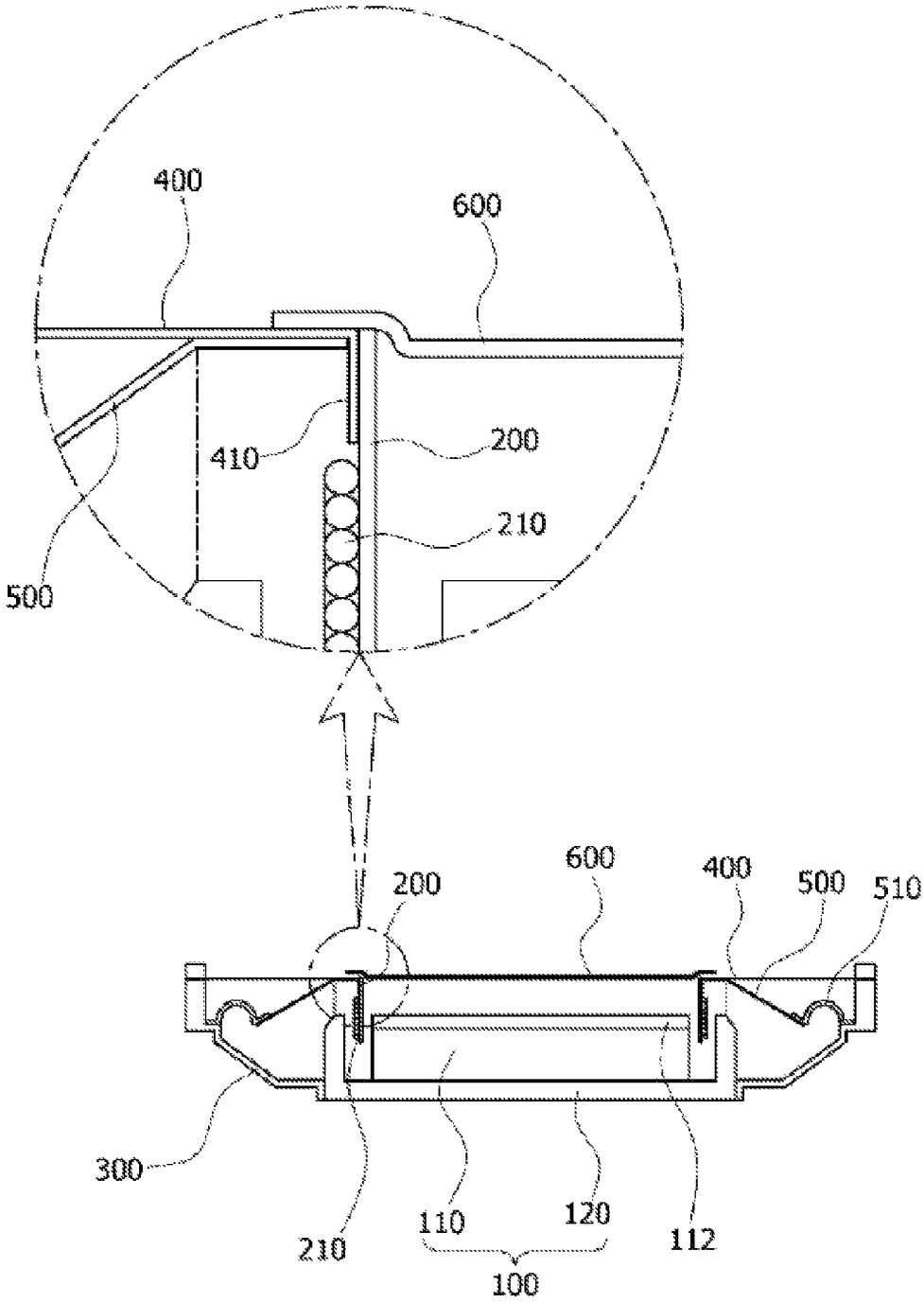
FIG. 6 is a sectional view showing a structure in which a bending part of a damper is coupled to an outer circumferential surface of a bobbin.
Figure 7:
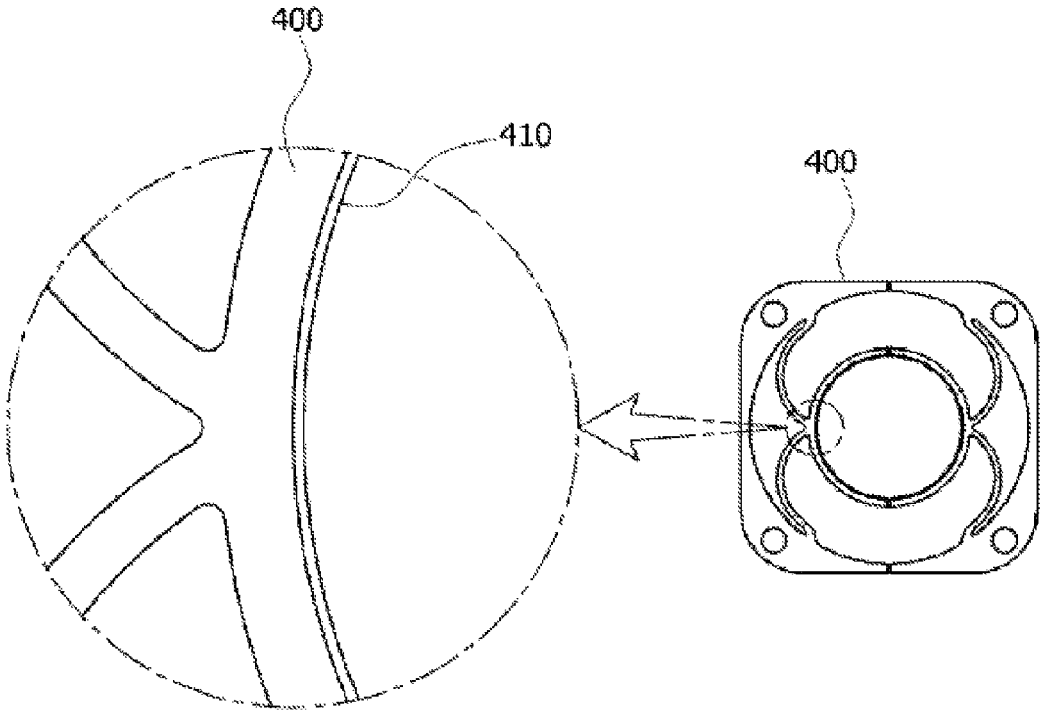
FIG. 7 is a plan view of the damper shown in FIG. 6.
Figure 8:
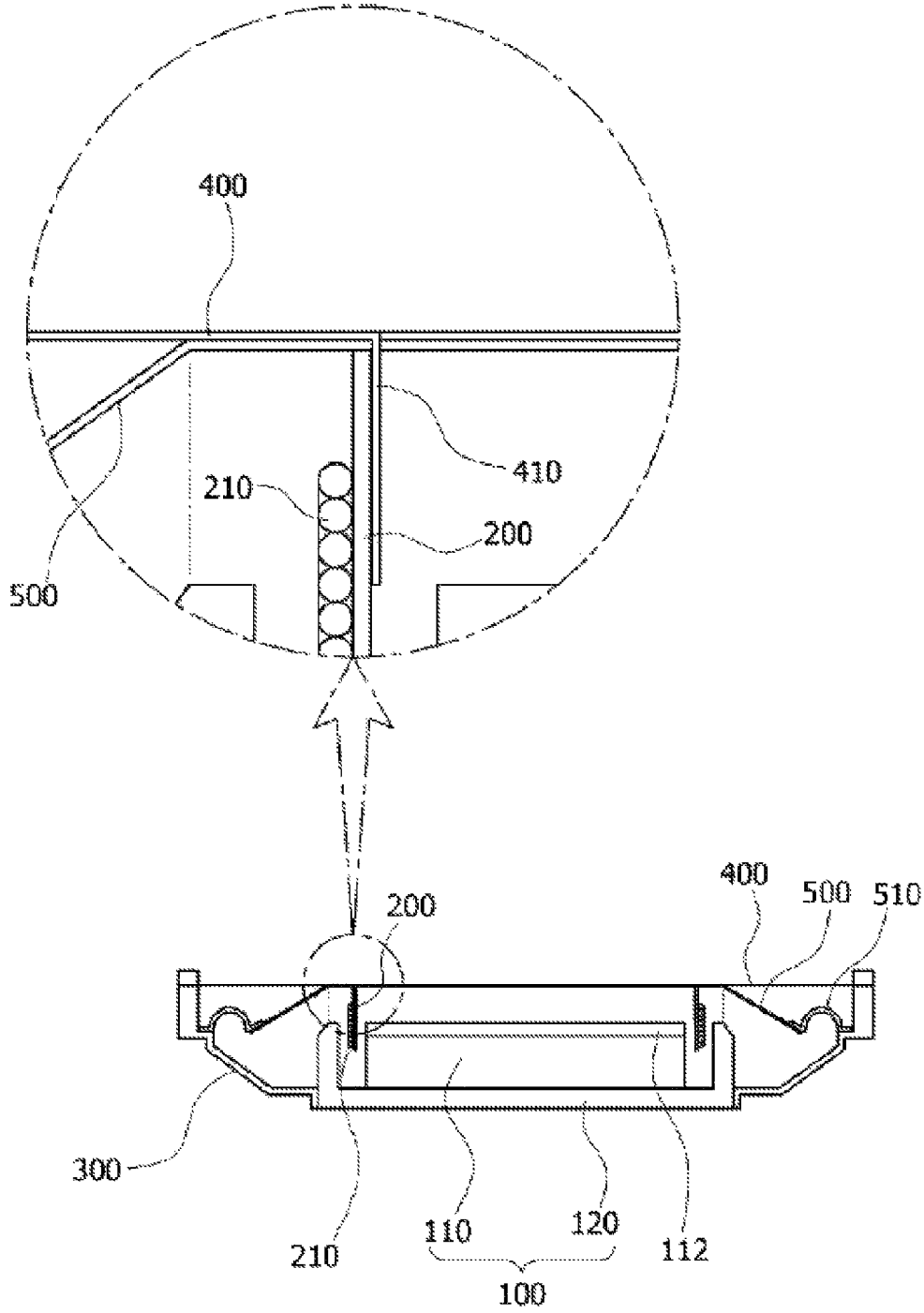
FIG. 8 is a sectional view showing a structure in which the bending part of the damper is coupled to an inner circumferential surface of the bobbin.
Figure 9:
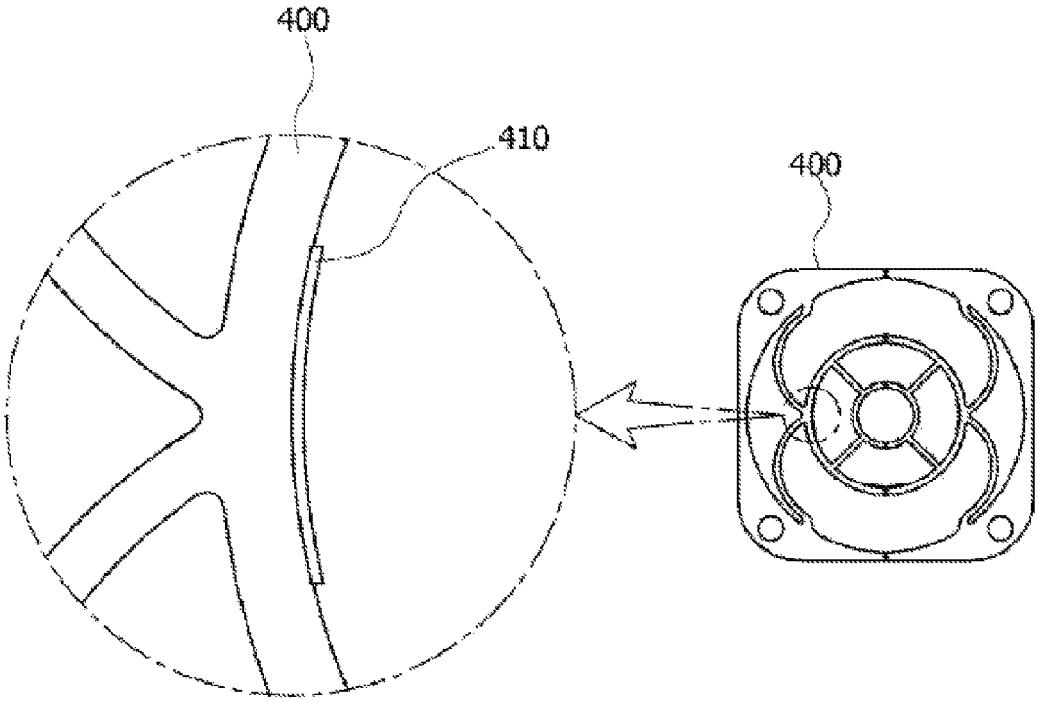
FIG. 9 is a plan view of the damper shown in FIG. 8.

FIG. 6 is a sectional view showing a structure in which a bending part 410 of the damper 400 is coupled to an outer circumferential surface of the bobbin 200. FIG. 7 is a plan view of the damper 400 shown in FIG. 6. FIG. 8 is a sectional view showing a structure in which the bending part 410 of the damper 400 is coupled to an inner circumferential surface of the bobbin 200. FIG. 9 is a plan view of the damper 400 shown in FIG. 8.

The damper 400 and the bobbin 200, applied to the slimline speaker according to the present invention, are formed in the shape of a thin plate. Hence, if the inside edge of the damper 400 is coupled to the outer circumferential surface of the bobbin 200 or the top of the bobbin 200 is coupled to the bottom of the damper 400 as shown in FIGS. 2 to 5, the coupling area is very narrow, and therefore, the damper 400 and the bobbin 200 may not be stably coupled to each other. Accordingly, the damper 400 may have a bending part 410 coupled to the outer or inner circumferential surface of the bobbin 200 so that the contact area between the damper 400 and the bobbin 200 is increased.

When the inside edge of the damper 400 is coupled to the outer circumferential surface of the bobbin 200 as shown in FIG. 2, the bending part 410 is preferably bent downward from the inside end of the damper 400 to be coupled to the outer circumferential surface of the bobbin 200 as shown in FIGS. 6 and 7. When the top of the bobbin 200 is coupled to the bottom of the damper 400 as shown in FIG. 3, the bending part 410 may be coupled to the inner circumferential surface of the bobbin 200 as shown in FIG. 8. Although not shown in a separate figure, the bending part 410 may be coupled to the outer circumferential surface of the bobbin 200.

Meanwhile, although only a case in which the bending part 410 is bent downward from the inside edge of the damper 400 is shown in FIG. 6, the bending part 410 may be bent upward from the inside edge of the damper 400. When the bending part 410 is bent upward from the inside edge of the damper 400 as described above, the mounting position of the damper 400 will be moved downward so that the bending part 410 can be coupled to the outer circumferential surface of the bobbin 200.

The bending part 410 may be formed at the entire part corresponding to the top of the bobbin 200 on the inner circumferential surface of the damper 400 as shown in FIG. 7, or may be formed at only a part of the entire part corresponding to the top of the bobbin 200 as shown in FIG. 9. The position and range of the bending part 410 to be formed may be variously modified according to the strength of a coupling force between the bobbin 200 and the damper 400 and materials of the bobbin 200 and the damper 400.

When the bending part 410 are formed at the entire part corresponding to the top of the bobbin 200 on the inner circumferential surface of the damper 400 and coupled to the outer circumferential surface of the bobbin 200, the diaphragm 500 cannot be directly coupled to the bobbin 200. Therefore, the diaphragm 500 is coupled to the bending part 410 as shown in the enlarged view of FIG. 6. When the bending part 410 is formed at only a part of the entire part corresponding to the top of the bobbin 200, the bending part 410 is coupled to the bobbin 200 by passing through the damper 400.

The coupling structure between the damper 400 and the bobbin 200 as described above is not applied to only the embodiments shown in FIGS. 2 and 3 but may be applied identically to the embodiments shown in FIGS. 4 and 5. When the coupling structure between the damper 400 and the bobbin 200, shown in FIGS. 6 to 9, is applied to the embodiments shown in FIGS. 4 and 5, the coupling structure between the damper 400 and the bobbin 200 is substantially identical except that the direction of the bending part 410 and the positions of the damper 400 and the diaphragm 500 are vertically reversed, and therefore, its detailed description will be omitted.

FIGS. 10 to 15 are sectional views showing structures in which the voice coil 210 is connected to the damper 400.

The damper 400 included in the slimline speaker according to the speaker may be configured to perform not only the function of guiding the vibration direction of the bobbin 200 but also the function of a terminal through which current is applied to the voice coil 210.

That is, the damper 400 is formed of a material such as metal having conductivity, and is divided into first and second dampers respectively coupled to the left and right sides of the bobbin 200 (See FIGS. 7 and 9). The voice coil 210 is connected to the first and second dampers so that current can be flowed therethrough. Thus, the first and second dampers can serve as terminals, respectively.

The structure in which the voice coil 210 is connected to the damper 400 will be described as follows.

When the inside edge of the damper 400 is coupled to the bobbin 200 as shown in FIG. 2, one end of the voice coil 210 may be coupled to the bottom of the damper 400 by passing through the diaphragm 500. When the bending part 410 coupled to the outer circumferential surface of the bobbin 200 is provided to the damper 400 as shown in FIG. 6, the voice coil 210 may be coupled to the bending part 410.

Figure 10:
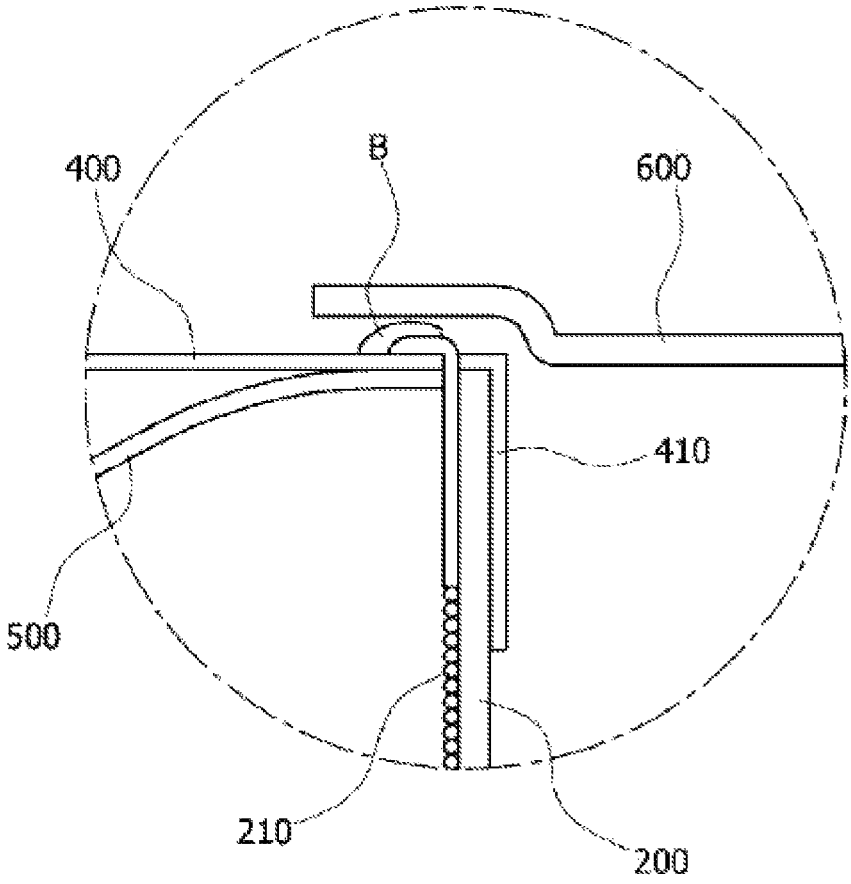
FIGS. 10 to 15 are sectional views showing structures in which a voice coil is connected to the damper.
Figure 11:
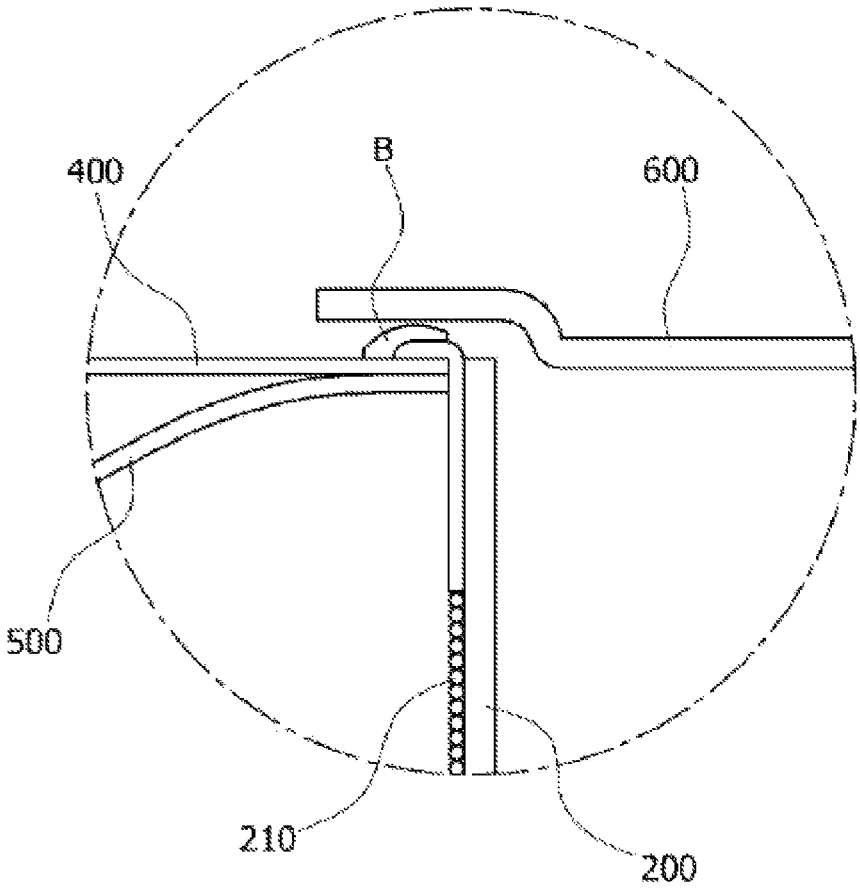

When the bending part is coupled to the inner circumferential surface of the bobbin 200, it is difficult that the voice coil 210 is coupled to the bending part 410. Therefore, the voice coil 210 is preferably coupled to a horizontal part of the damper 400. In this case, the end of the voice coil 210 may be coupled to the bottom of the damper 400. However, the end of the voice coil 210 is preferably coupled to pass through the diaphragm 500 and the damper 400 and then lie down on the top of the damper 400 as shown in FIG. 10. The structure in which the end of the voice coil 210 is coupled to the top of the damper 400 as described above may also be applied identically to the structure in which the inside edge of the damper 400 is coupled to the outer circumferential surface of the bobbin 200 as shown in FIG. 11.

For reference, 'B' shown in FIGS. 10 to 15 denotes a solder bead.

Figure 12:
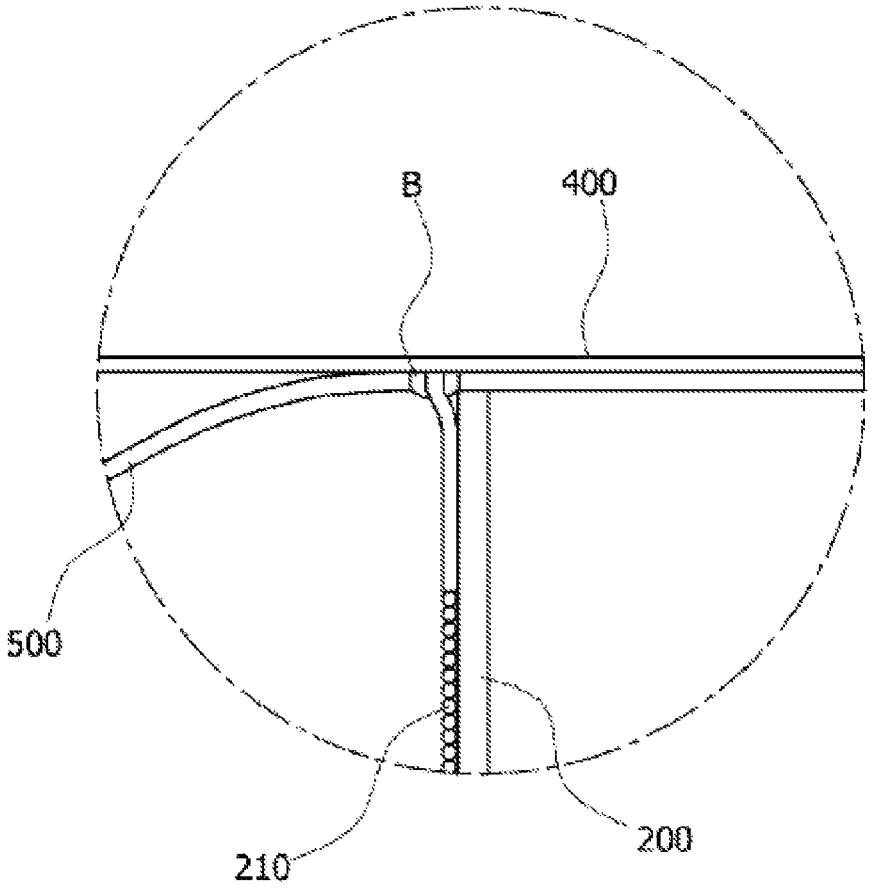
Figure 13:
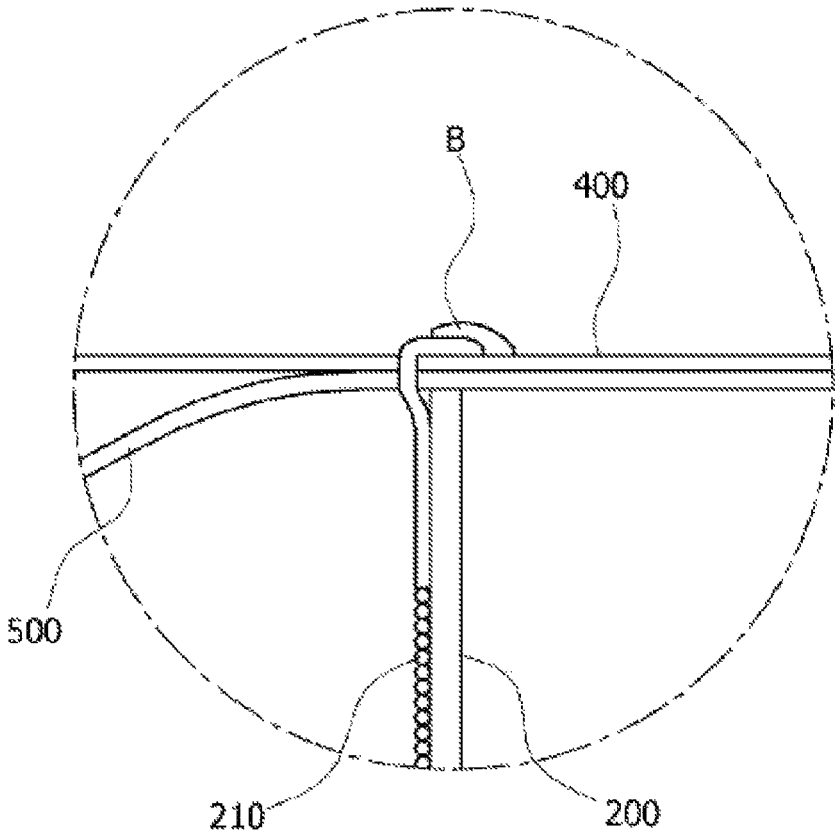
Figure 14:
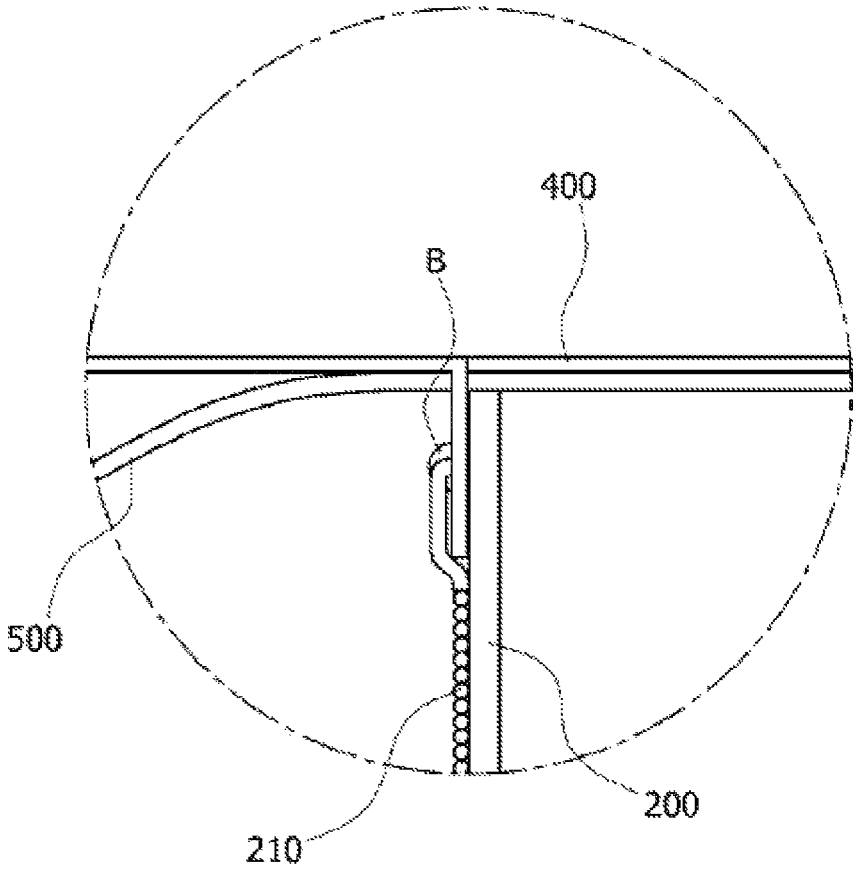
Figure 15:
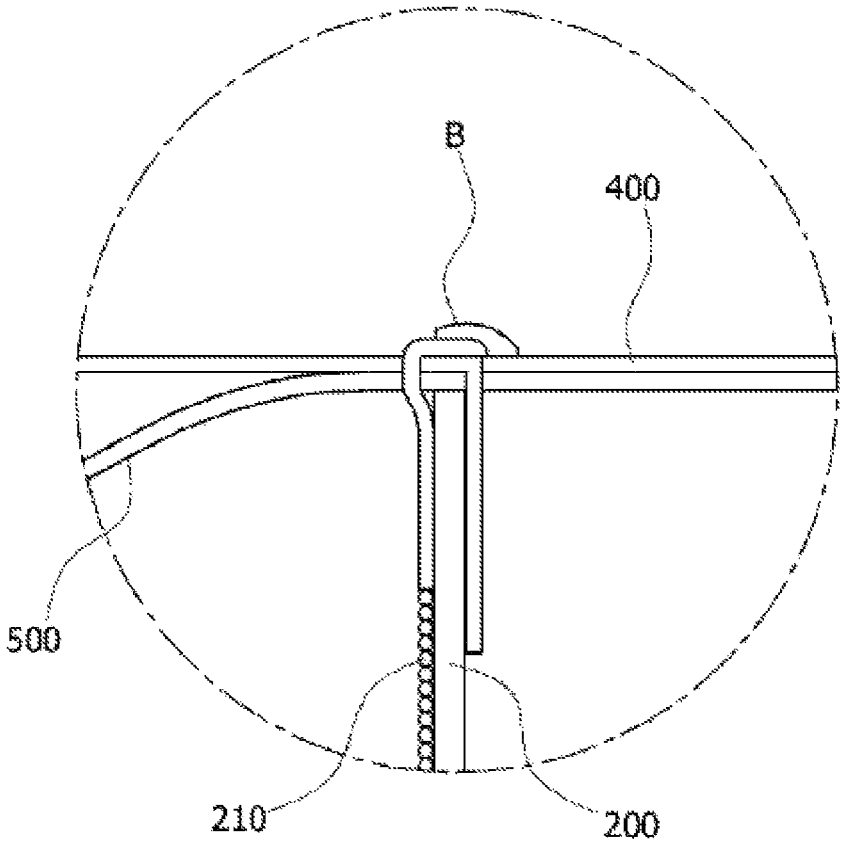

When the diaphragm 500 and the damper 400 are coupled to the bobbin 200 so as to sequentially cover the top of the bobbin 200 as shown in FIG. 3, the voice coil 210 may be coupled to the bottom of the damper 400 by passing through only the diaphragm 500 as shown in FIG. 12, or may be coupled to the top of the damper 400 by passing through both the diaphragm 500 and the damper 400 as shown in FIG. 13. Alternatively, the voice coil 210 may be coupled to the bending part 410 coupled to the outer circumferential surface of the bobbin 200 as shown in FIG. 14. When the bending part 410 is coupled to the inner circumferential surface of the bobbin 200, the voice coil 210 is preferably coupled to the top of the damper 400 by passing through both the diaphragm 500 and the damper 400 as shown in FIG. 15.

Since only the structure in which the voice coil 210 is mounted on only the outer circumferential surface of the bobbin 200 is shown in this embodiment, the voice coil 210 is not coupled to the bending part 410 when the bending part 410 is coupled to the inner circumferential surface of the bobbin 200. However, in a case in which the voice coil 210 is mounted on the inner circumferential surface of the bobbin 200, the voice coil 210 may be coupled to the bending part 410 when the bending part 410 is coupled to the inner circumferential surface of the bobbin 200. That is, when the voice coil 210 and the bending part are all mounted on any one surface of the bobbin 200, the voice coil 210 is preferably coupled to the bending part 410.

Meanwhile, the coupling structure between the voice coil 210 and the damper 400, shown in FIGS. 10 to 15, may also be applied identically to the structure in which the bobbin 200 is positioned at the lower side of the magnetic circuit 100 (See FIGS. 3 and 4). The coupling structure between the voice coil 200 and the damper 400 is substantially identical except that the positions of the magnetic circuit 100 and the bobbin 200 are vertically reversed, and therefore, its detailed description will be omitted.

Figure 16:
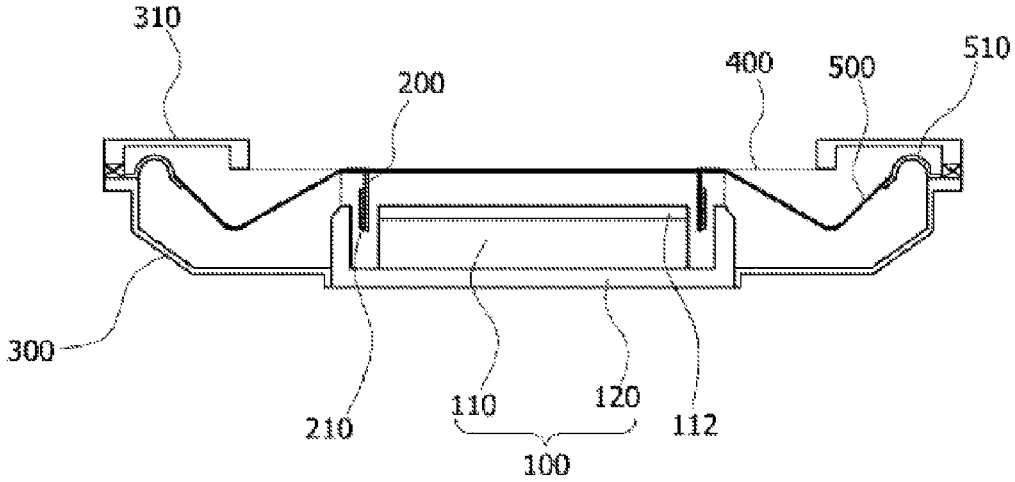
FIG. 16 is a sectional view of a slimline speaker according to a fifth embodiment of the present invention.

FIG. 16 is a sectional view of a slimline speaker according to a fifth embodiment of the present invention.

If the diaphragm 500 is formed to slope in any one of upper and lower directions as shown in the embodiments of FIGS. 2 to 5, the difference in height between the inside and outside edges becomes large as the size and slope angle of the diaphragm 500 are increased, and therefore, the entire thickness of the slimline speaker is increased.

Accordingly, in order to decrease the difference in height between the inside and outside edges, the diaphragm 500 applied to the slimline speaker according to this embodiment, as shown in FIG. 16, may be formed so that a central part, i.e., a part between the inside and outside edges is bent or curved once or more, and parts from the bent or curved point to the inside and outside edges may be formed to slope. If the central part of the diaphragm 500 is formed in the shape bent or curved once or more as described above, the diaphragm 500 has sloped surfaces, so that it is possible to reduce deformation such as warp in vibration of the diaphragm 500 and to decrease the difference in height between the inside and outside edges. According to the entire height of the slimline speaker can be decreased.

Meanwhile, the base frame 300 included in this embodiment may further comprise an auxiliary frame 310 extended toward the bobbin 200 from the outside edge of the base frame 300. The damper 400 may be configured so that the outside edge of the damper 400 is coupled to the auxiliary frame 310.

If the damper 400 is not coupled directly to the base frame 300 but coupled to the auxiliary frame 310 as described above, the size of the damper 400 can be decreased. The size and shape of the damper 400 may be differently formed for each model of products. When the auxiliary frame 310 is additionally provided to the base frame 300 in the embodiment shown in FIG. 16, the base frame 300 can be commonly used regardless of models of the products, and only the auxiliary frame can be replaced according to the size and shape of the damper 400, thereby reducing manufacturing cost.

The shape and material of the damper described in the present invention may be variously formed and applied, and the damper may be divided into two or more so as to be limitedly coupled to a part of the diaphragm or the bobbin.

Although the present invention has been described in connection with the accompanying drawings and the preferred embodiments, the present invention is not limited thereto but defined by the appended claims. Accordingly, it will be understood by those skilled in the art that various modifications and changes can be made thereto without departing from the spirit and scope of the invention defined by the appended claims.

INDUSTRIAL APPLICABILITY

According to the present invention, it is possible to manufacture slimline products by decreasing the entire height of the product and to decrease the entire height of the product even while applying a diaphragm formed in a shape for preventing deformation by increasing the strength of the diaphragm, i.e., a diaphragm formed to slope or bend so that the diaphragm is suitable for middle/low and high power.

The invention claimed is:

1. A slim-type speaker, comprising:

a magnetic circuit comprising a magnet and a yoke, wherein the yoke includes a bottom portion and a sidewall, and the magnet and the sidewall of the yoke are arranged to form a separation space between the magnet and the sidewall of the yoke in a horizontal direction;

a bobbin on which a voice coil is mounted, and a lower side of which is inserted in the separation space between the magnet and the sidewall of the yoke;

a base frame on which the yoke of the magnetic circuit is mounted;

a damper, an inner end of which is connected to the bobbin and an outer end of which is connected to the base frame; and a diaphragm connected to a predetermined position of the bobbin which is lower than a position where the damper is connected, wherein the diaphragm comprises:

a surface connection portion having an outer end and extending from the outer end of the surface connection portion to the bobbin in the horizontal direction, wherein a top surface of the surface connection portion comes into surface contact with a bottom surface of the damper, a part of the surface connection portion is disposed directly above an upper surface of the sidewall of the yoke and the separation space in a vertical direction, and the outer end of the surface connection portion corresponds to a vertical line of an outermost position on the upper surface of the sidewall of the yoke; and an inclined portion extending inclinedly from the outer end of the surface connection portion such that an outer end of the inclined portion is connected to the base frame.

2. The slim-type speaker of claim 1, further comprising a dust cap for covering the top of an internal space of the bobbin.

3. A slim-type speaker, comprising:

a magnetic circuit comprising a magnet and a yoke, wherein the yoke include a bottom portion and a sidewall, and the magnet and the sidewall of the yoke are arranged to form a separation space between the magnet and the sidewall of the yoke in a horizontal direction;

a bobbin on which a voice coil is mounted, and a lower side of which is inserted in the separation space between the magnet and the sidewall of the yoke;

a base frame on which the yoke of the magnetic circuit is mounted;

a diaphragm comprising a surface connection portion having an outer end and extending from the outer end of the surface connection portion the bobbin in the horizontal direction to cover an upper end of the bobbin, and an inclined portion extending inclinedly from the outer end of the surface connection portion such that an outer end of the inclined portion is connected to the base frame, wherein a part of the surface connection portion is disposed directly above an upper surface of the sidewall of the yoke in a vertical direction, and the outer end of the surface connection portion corresponds to a vertical line of an outermost position on the upper surface of the sidewall of the yoke; and a damper, an inner-end bottom surface of which is connected to come into surface contact with a top surface of the surface connection portion, and an outer end of which is connected to the base frame.

4. The slim-type speaker of claim 1, wherein the inclined portion is inclinedly formed such that the outer end of the inclined portion is lower than an inner end of the inclined portion.

5. The slim-type speaker of claim 1, wherein the inclined portion is bent or curved one or more times between an inner end of the inclined portion and the outer end of the inclined portion.

6. The slim-type speaker of claim 1, wherein the damper comprises a bent portion connected to an outer peripheral surface or an inner peripheral surface of the bobbin.

7. The slim-type speaker of claim 1, wherein the damper is made of a conductive material, and the voice coil is connected to the damper so that an electric current is applied thereto.

8. The slim-type speaker of claim 7, wherein the damper is divided into a first damper and a second damper connected to a left side and a right side of the bobbin, respectively, and both sides of the voice coil are connected to the first damper and the second damper, respectively, so that an electric current is applied thereto.

9. The slim-type speaker of claim 7, wherein the voice coil is connected to the damper after one end of the voice coil passes through the diaphragm.

10. The slim-type speaker of claim 7, wherein the damper comprises a bent portion, which is bent downward, passes through the diaphragm, and is connected to an outer peripheral surface or an inner peripheral surface of the bobbin, and the voice coil is connected to the bent portion.

11. The slim-type speaker of claim 1, wherein the yoke is formed in a concave shape, and the magnet is mounted inside the yoke such that an outer-end surface of the magnet is spaced apart from an inner-end wall surface of the sidewall of the yoke.

12. A slim-type speaker, comprising:

a base frame;

abridge disposed such that a bottom surface of the bridge is spaced apart from a top surface of the base frame, and an outer end of the bridge is connected to an outer end of the base frame;

a magnetic circuit comprising a magnet and yoke, wherein the yoke includes a bottom portion and a sidewall, and the magnet and the sidewall of the yoke are arranged to form a separation space between the magnet and the sidewall of the yoke in a horizontal direction, the magnetic circuit being connected to the bottom surface of the bridge;

a bobbin on which a voice coil is mounted, and an upper side of which is inserted in the separation space between the magnet and the sidewall of the yoke;

a damper, an inner end of which is connected to the bobbin and an outer end of which is connected to the base frame or the bridge; and a diaphragm connected to a predetermined position of the bobbin which is higher than a position where the damper is connected, wherein the diaphragm comprises:

a surface connection portion having an outer end and extending from the outer end of the surface connection portion to the bobbin in the horizontal direction, wherein a bottom surface of the surface connection portion comes into surface contact with a top surface of the damper, a part of the surface connection portion is disposed directly below an upper surface of the sidewall of the yoke in a vertical direction, and the outer end of the surface connection portion corresponds to a vertical line of an outermost position on the upper surface of the sidewall of the yoke; and an inclined portion extending inclinedly from the outer end of the surface connection portion such that an outer end of the inclined portion is connected to the base frame or the bridge.

13. The slim-type speaker of claim 12, further comprising a dust cap covering a lower inner space of the bobbin.

14. A slim-type speaker, comprising:

a base frame;

a bridge disposed such that a bottom surface of the bridge is spaced apart from a top surface of the base frame, and an outer end of the bridge is connected to an outer end of the base frame;

a magnetic circuit comprising a magnet and yoke, wherein the yoke includes a bottom portion and a sidewall, and the magnet and the sidewall of the yoke are arranged to form a separation space between the magnet and the sidewall of the yoke in a horizontal direction, the magnetic circuit being connected to the bottom surface of the bridge;

a bobbin on which a voice coil is mounted, and an upper side of which is inserted in the separation space between the magnet and the sidewall of the yoke;

a diaphragm comprising a surface connection portion having an outer end and extending from the outer end of the surface connection portion to the bobbin in the horizontal direction to cover a lower end of the bobbin, and an inclined portion extending inclinedly from the outer end of the surface connection portion such that an outer end of the inclined portion is connected to the base frame or the bridge, wherein a part of the surface connection portion is disposed directly below an upper surface of the sidewall of the yoke in a vertical direction, and the outer end of the surface connection portion corresponds to a vertical line of an outermost position on the upper surface of the sidewall of the yoke; and a damper, an inner-end top surface of which is connected to come into surface contact with a bottom surface of the surface connection portion, and an outer end of which is connected to the base frame or the bridge.

15. The slim-type speaker of claim 12, wherein the inclined portion is inclinedly formed such that the outer end of the inclined portion is higher than an inner end of the inclined portion.

16. The slim-type speaker of claim 12, wherein the inclined portion is bent or curved one or more times between an inner end of the inclined portion and the outer end of the inclined portion.

17. The slim-type speaker of claim 12, wherein the damper comprises a bent portion connected to an outer peripheral surface or an inner peripheral surface of the bobbin.

18. The slim-type speaker of claim 12, wherein the damper is made of a conductive material, and the voice coil is connected to the damper so that an electric current is applied thereto.

19. The slim-type speaker of claim 18, wherein the damper is divided into a first damper and a second damper connected to a left side and a right side of the bobbin, respectively, and both sides of the voice coil are connected to the first damper and the second damper, respectively, so that an electric current is applied thereto.

20. The slim-type speaker of claim 18, wherein the voice coil is connected to the first damper and the second damper, respectively after one end of the voice coil passes through the diaphragm.

21. The slim-type speaker of claim 18, wherein the damper comprises a bent portion, which is bent downward, passes through the diaphragm and is connected to an outer peripheral surface or an inner peripheral surface of the bobbin, and the voice coil is connected to the bent portion.

22. The slim-type speaker of claim 1, wherein the base frame further comprises an auxiliary frame extending from an outer end of the base frame toward the bobbin, and the outer end of the damper is connected to the auxiliary frame.

* * * * *